US006286579B1

(12) United States Patent
Gottschalk

(10) Patent No.: US 6,286,579 B1
(45) Date of Patent: Sep. 11, 2001

(54) RETRACTABLE STORM SHADE SYSTEM

(76) Inventor: Douglas Gottschalk, 830 W. Beach Blvd., #7, Long Beach, MS (US) 39560

( * ) Notice: Subject to any disclaimer, the term of this patent is extended or adjusted under 35 U.S.C. 154(b) by 0 days.

(21) Appl. No.: 09/716,769

(22) Filed: Nov. 20, 2000

Related U.S. Application Data

(63) Continuation of application No. 09/186,563, filed on Nov. 5, 1998, now abandoned.

(51) Int. Cl.[7] ..... A47G 5/02

(52) U.S. Cl. ..... 160/264; 160/183; 160/229.1; 160/232

(58) Field of Search ..... 160/23.1, 183, 160/229.1, 232, 264, 271, 273.1, 275

(56) References Cited

U.S. PATENT DOCUMENTS

| | | | | |
|---|---|---|---|---|
| 970,135 | | 9/1910 | Taylor . | |
| 1,164,385 | | 12/1915 | Neupauer | 160/264 |
| 1,241,425 | | 9/1917 | Nelson | 160/264 |
| 1,583,133 | | 5/1926 | Fierman | 160/264 |
| 3,583,465 | * | 6/1971 | Youngs et al. | 160/264 |
| 3,853,166 | | 12/1974 | Wrono | 160/133 |
| 4,222,401 | | 9/1980 | Allweil | 135/1 R |
| 4,619,305 | | 10/1986 | Comeau | 160/263 |
| 4,889,176 | | 12/1989 | Nilsson | 160/264 |
| 4,934,435 | | 6/1990 | Regev | 160/264 X |
| 5,099,905 | | 3/1992 | Rigter | 160/273.1 |
| 5,123,473 | * | 6/1992 | Henkenjohann | 160/264 |
| 5,199,479 | * | 4/1993 | Kraeutler | 160/264 X |
| 5,238,284 | | 8/1993 | Whitaker | 296/37.16 |
| 5,287,908 | | 2/1994 | Hoffmann et al. | 160/121.1 |
| 5,323,831 | | 6/1994 | Manthei | 160/23.1 |
| 5,443,563 | | 8/1995 | Hindel et al. | 160/238 |
| 5,456,305 | | 10/1995 | Snarli | 160/133 |
| 5,575,322 | | 11/1996 | Miller | 160/133 |
| 5,595,233 | | 1/1997 | Gower | 160/232 |
| 5,620,040 | * | 4/1997 | Swanner | 160/264 X |
| 6,015,184 | * | 1/2000 | Ewing et al. | 160/352 X |
| 6,116,319 | * | 9/2000 | Simon | 160/264 X |
| 6,155,326 | * | 12/2000 | Imhoff et al. | 160/243 |
| 5,862,850 | | 1/1999 | Yang | 160/264 X |
| 5,964,270 | * | 10/1999 | Kirkey et al. | 160/264 X |

* cited by examiner

*Primary Examiner*—Bruce A. Lev
(74) *Attorney, Agent, or Firm*—Garvey, Smith, Nehrbass & Doody, LLC

(57) ABSTRACT

A storm protection system for openings such as windows which include an upper housing, mountable on the upper or lower, in some applications, edge of the window, the housing accommodating a reinforced fabric shade being substantially the width of the window, on a roller within the housing so that the shade may be pulled from a first storage position within the housing to a second down position so that it would completely cover the window opening. There is further provided a plurality of spaced apart pockets formed within the fabric shade, and extending along its entire length, each of the pockets accommodating a length of a tubular member such as a section of PVC pipe, which would slidably engage within the pockets to form a plurality of reinforced members along the length of the shade as the shade is pulled downward. There is further provided a plurality of raised members mountable on the window sill or the like place, each of the raised members spaced apart equal distance as the spaced apart pockets in the shade. In the preferred embodiment, when the shade has been pulled down and the tubular member is slidable within the pockets, the upper ends of the tubular members would be engaged along a plurality of raised members positioned on the underside of the housing, and the lower ends of the tubular members would be engaged onto the raised members positioned on the window sill. The tubular members would be such a length that when the lower ends are engaged the upper and lower members, it would create a slight outward bow of the PVC pipes, so that any object which would make contact with the shade, the outer bow of the pipes would provide further protection against impact and greater absorption of the impact of the debris making contact therewith. This system also allows for some light and ventilation prior to, during lulls or ebbs, and after the storm while fully in place.

9 Claims, 3 Drawing Sheets

RETRACTABLE STORM SHADE SYSTEM

CROSS-REFERENCE TO RELATED APPLICATIONS

This application is a continuation of application Ser. No. 09/186,563 filed Nov. 5, 1998, now abandoned.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The system of the present invention relates to storm protection systems for windows. More particularly, the present invention relates to a reinforced retractable shade mounted above openings such as windows in a building for extending down to cover the window and including reinforcement members for protecting the window against storm related damage.

2. General Background of the Invention

In areas of the country or world which are prone to storms, there is a need for protecting the openings of buildings such as windows and doors and other means of access. Often times such openings are covered with breakable glass, and during a storm when a loose object, such as a tree limb or the like, is blown into the glass covering the opening, there is a danger that people within the building will be injured or killed by the flying glass. For example, the states along the Gulf of Mexico, during certain times of the year, are prone to enormous and deadly storms known as hurricanes. Hurricanes often have winds which blow between an average of 100 to 125 miles per hour, and in doing so, are able to blow foreign objects such as street signs, tree limbs and other types of debris into the windows of buildings, more particularly to individual homes within cities and towns affected by the storm. At the present, there are some systems on the market which may allow windows, etc. to be covered by protective coverings known as "storm windows", which are normally metallic type shades that are rolled down in front of the windows to form a metallic barrier between the outside and the window. These systems, although effective, are quite expensive, and because of the amount of steel and other metal that is involved, require either electric or hydraulic means to move the storm window in place, also being architecturally and physically cumbersome.

Therefore, there is a need in the industry for a relatively simple storm system that could be installed by the owner of the home, yet could be highly effective in protecting the windows and doors of buildings from flying debris during hurricanes or the like storms, when not in use, can be retracted to a position above the window, or the entire system could be removed from the window and stored away while not in use, or build in as an integral element of said structure.

BRIEF SUMMARY OF THE INVENTION

The system of the present invention solves the shortcomings in the art in a simple and straightforward manner. What is provided is a storm protection system for openings such as windows which include an upper housing, mountable above the upper edge of the window, the housing accommodating a reinforced fabric shade being substantially the width of the window, on a roller within the housing so that the shade may be pulled from a first storage position within the housing to a second down position so that it would completely cover the window opening. There is further provided a plurality of spaced apart pockets formed within the fabric shade, and extending along its entire length, each of the pockets accommodating a length of a tubular member such as a section of PVC pipe, which would slidably engage within the pockets to form a plurality of reinforced members along the length of the shade as the shade is pulled downward. There is further provided a plurality of raised members mountable on the window sill or the like place, each of the raised members spaced apart equal distance as the spaced apart pockets in the shade. In the preferred embodiment, when the shade has been pulled down and the tubular member is slidable within the pockets, the upper ends of the tubular members would be engaged along a plurality of raised members positioned on the underside of the housing, and the lower ends of the tubular members would be engaged onto the raised members positioned on the window sill. The tubular members would be such a length that when the lower ends are engaged with the upper and lower members, it would create an outward bow of the PVC pipes, so that any object which would make contact with the shade, the outer bow of the pipes would provide further protection against impact and greater absorption of the impact of the debris making contact therewith.

Therefore, it is the principal object of the present invention to provide a storm protection system, which is mountable on the exterior of a building, so that the system may be moved from a first retracted position to a second extended position and engaged to protect the window openings.

It is a further object of the present invention to provide a storm protection system having a shade member that can be extended downward along a window opening, and accommodating a plurality of reinforcement tubes, to define a stronger protection barrier between the outside and the window.

It is a further object of the present invention to provide a storm protection system which can be mounted on the exterior of windows, etc. allowing light penetration and ventilation prior to, during lulls in and immediately after the storm while still in place.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
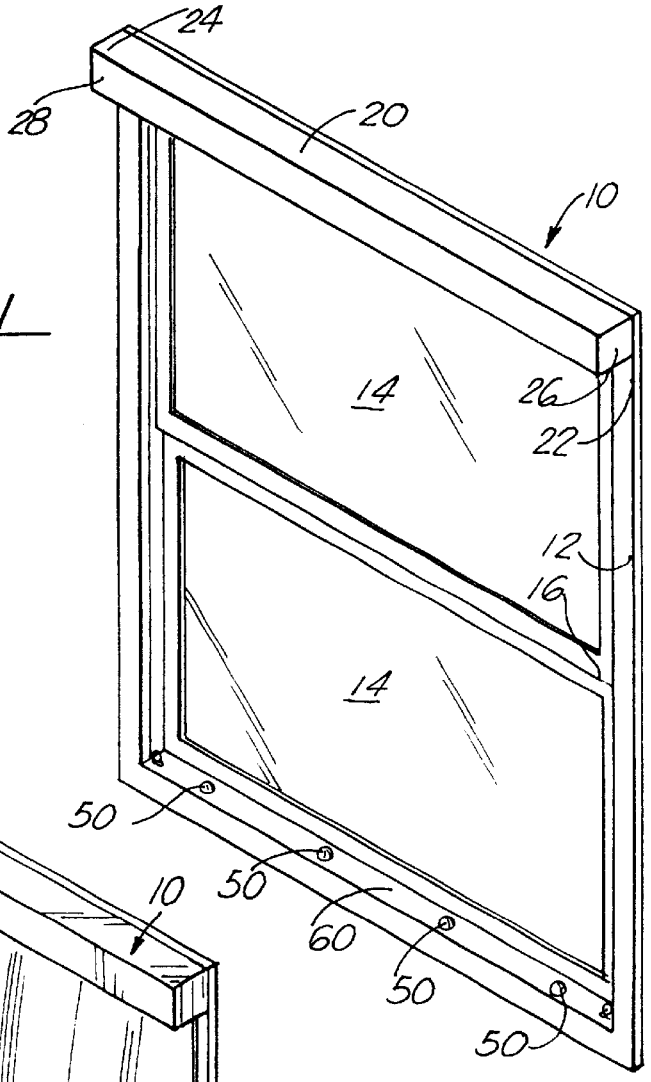
FIG. 1 is an overall view of a window with the storm system mounted thereto and the shade retracted therein.

As illustrated in FIG. 1, system 10 is illustrated mounted upon an exterior window 12 which would be the type of window found in a home or the like structure having a pane glass 14 and a window frame 16 there around. As illustrated, there is seen the entire upper or lower (in some applications) housing 20 of the present invention mounted along the face 22 of the window frame 16, with the housing including an upper housing wall 24, a pair of end panels 26, a forward face 28, and a lower base member 30, as seen more clearly in FIG. 5. Although not seen in FIG. 1, reference is made to FIGS. 3 and 5 where there is illustrated a roll of reinforced fabric material 32 housed within frame in upper housing 20, with the forward space 28 of frame 20 and the base 30 of frame 20 defining a gap 34 therebetween, so that the layer of fabric 36 in roll 32 may be pulled therefrom. As seen in FIG. 2, again there is illustrated the system 10 with upper housing 20 mounted against window 12, and in this illustration, the fabric 36 has been pulled through opening 34 of housing 20, and completely covers the entire windowpane 14 as was illustrated in FIG. 1.

Figure 2:
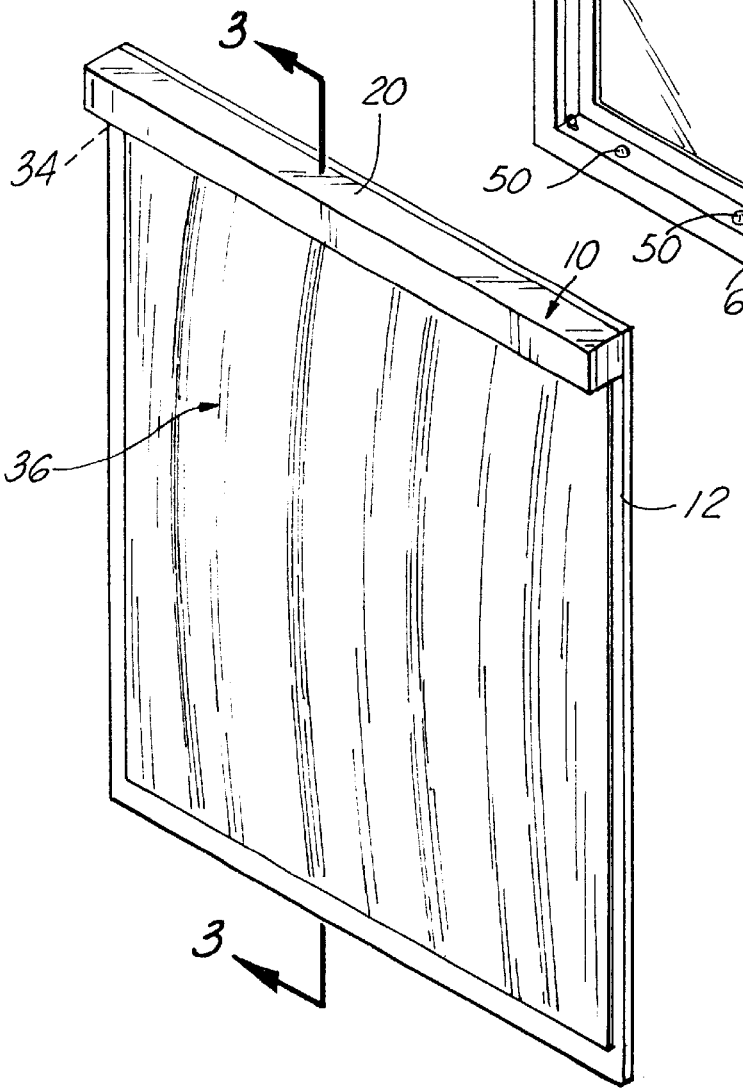
FIG. 2 is an overall view of the system of the present invention with the reinforced shade extended to the protective position.
Figure 3:
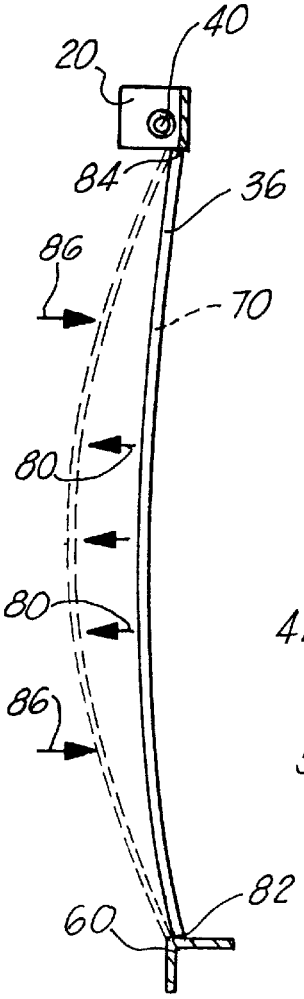
FIG. 3 is a side view along lines 3—3 in FIG. 2.
Figure 4:
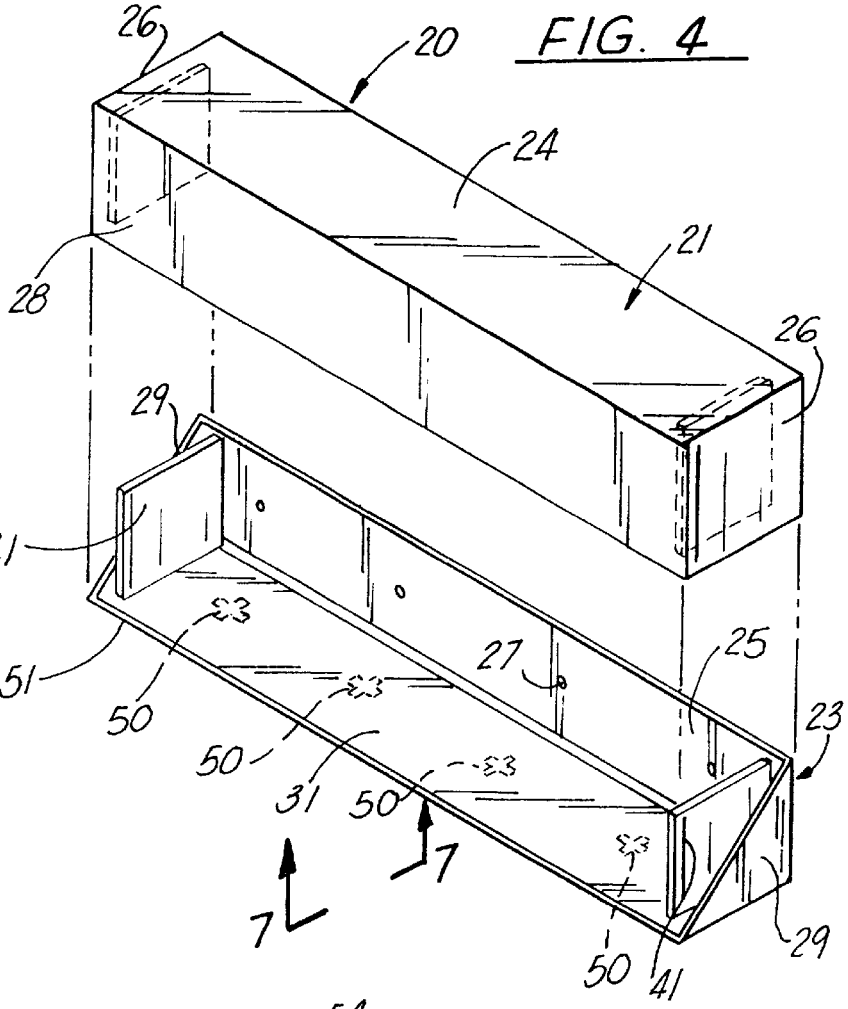
FIG. 4 is a partial view of the upper and lower housing members in relation to one another of the system of the present invention.
Figure 5:
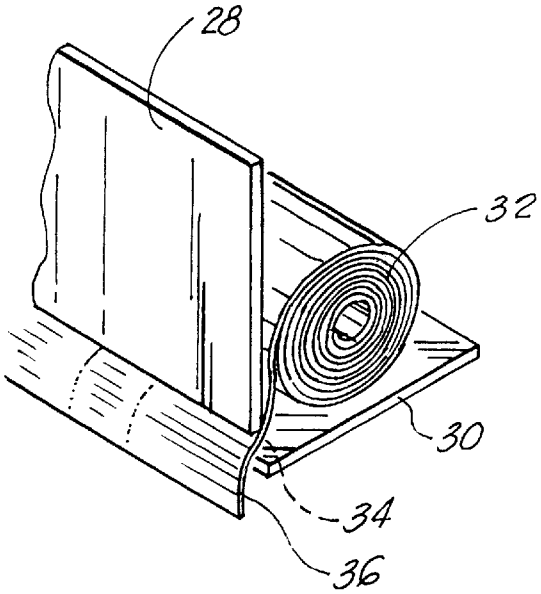
FIG. 5 is a partial view of the fabric roll contained within the upper housing of the present invention.

Reference is now made to the Figures for a discussion of the manner in which the reinforced fabric 36 as seen in FIG. 2 is maintained in place against window 12, and the manner in which it protects window 12 from foreign debris. As seen in FIG. 4, the upper housing 20 is seen in exploded view, showing that the housing 20 would include a cap portion 21, having the upper wall 24, the forward face 28 and the end portions 26, would slidably engage a lower base portion 23 which also includes a rear face 25 having a plurality of ports 27 to which screws or the like would be mounted against the upper portion of the window frame 16 for mounting it in place. Lower base portion 23 would further include a pair of triangulated side walls 29 and a base portion 31, wherein the upper cap 21 would slidably engage thereupon. Of course, as discussed earlier, the fabric roll 32 would be mounted upon a roller 40, as seen in FIG. 3, with the roller 40 engaged against the two end members 41, as seen in FIG. 4, so that the roller 40 would roll in a similar fashion as a window shade as the fabric 36 is pulled therefrom as seen in FIG. 5.

Figure 7:
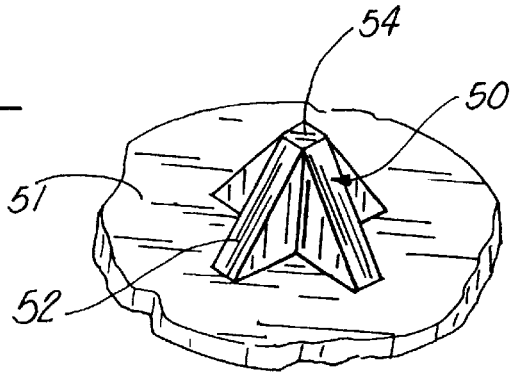
FIG. 7 is a partial view of the raised members on the base of the lower housing of the present invention.

Further, as illustrated in FIG. 4, there is seen a plurality of raised members 50, which extend downward from the lower face of 51 of base plate 31, each of the members would be designed in the configuration as seen in FIG. 7, that is, having a series of wing members 52 attached to the under surface 51 of base 31 and terminating in a truncated point 54. As illustrated, there would be a plurality of four such members 50 along the length of base plate 31. Likewise, as illustrated in FIG. 1, there would be a plurality of such raised members 50 positioned on the upper face 60 of window frame 16, the function of the raised members 50 to be discussed further. For purposes of construction, the raised members 50 could be simplified in that they could simply be a threaded stud extending outward in place of the raised members 50 which would be a simplified version of the type of mounting member that would be utilized with the present invention.

Figure 6:
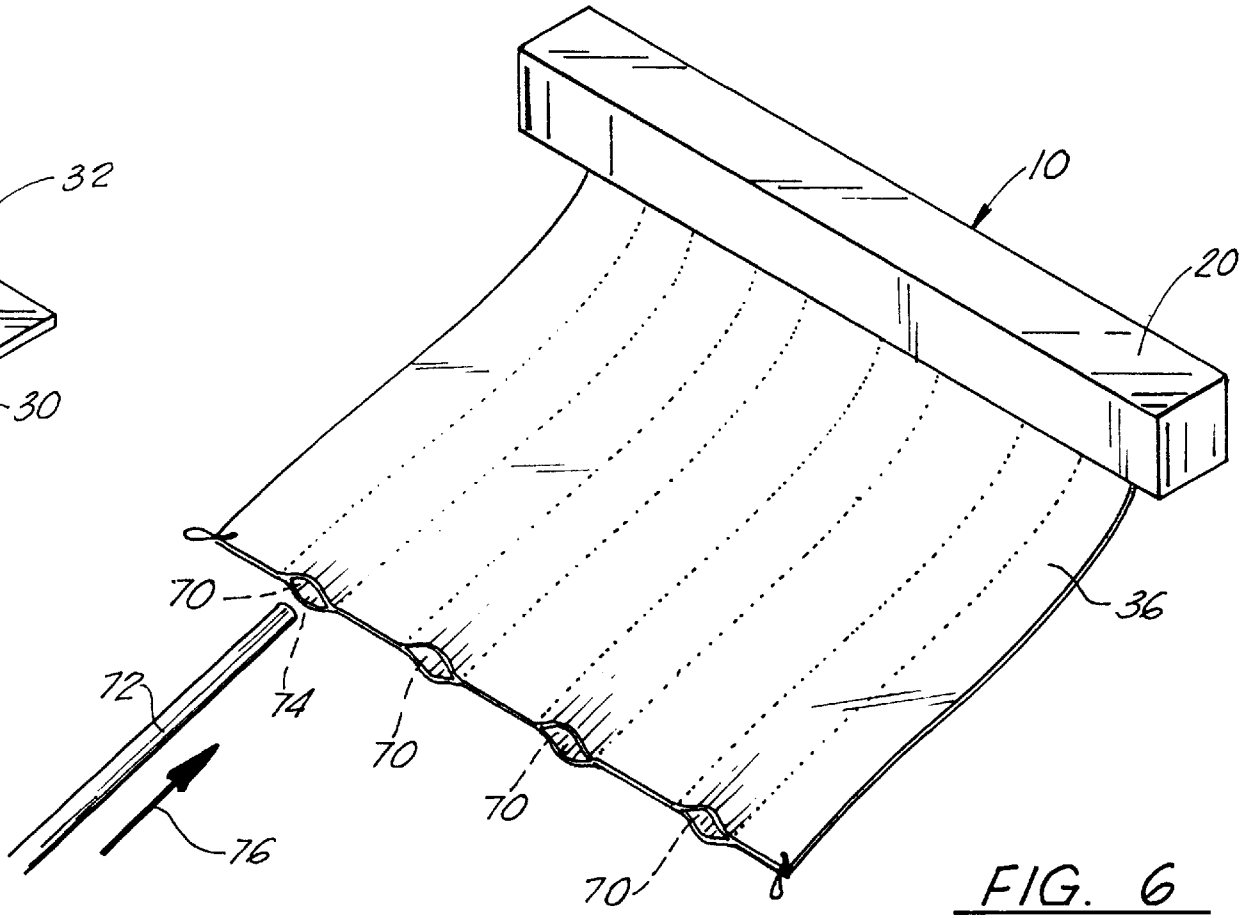
FIG. 6 is a partial view of the extended shade illustrating the tubular members being inserted therein.

Turning now to FIG. 6, there is illustrated the system 10 with the fabric 36 being pulled from the upper housing 20. As illustrated, the fabric would also form a plurality of pockets 70 spaced apart along its length, each of the pockets being open ended on both their upper and lower ends so that a tubular member such as a length of PVC pipe 72 halving a continuous wall portion and a hollow portion 74 may be slidably engaged into each of the pockets along their entire length as seen by arrow 76. After each of the PVC members 72 have been engaged within each of the pockets 70, reference is made to FIG. 7, where there is illustrated in side view the fabric 36 housing each of the pipes 72 as seen in FIG. 6, in each of the pockets 70. In this position there is illustrated the base 60 of the window frame and the upper portion being the upper housing 20 of the system. It is noted that the fabric which contains the pipes 72 is bowed vertically outward both laterally and vertically in the direction of arrows 80, in FIG. 3. This accomplished by the lower end of the pipe 72 being engaged upon the members 50 positioned on the surface 60 of sill 16 as illustrated in FIG. 1, and the upper end of each of the pipes 72 being engaged against the members 50 which are positioned on the lower face 51 of floor portion 31 of housing 23, and (laterally-horizontally) by a bowing of the roller offering a baffle effect. Therefore, the pipes are of sufficient length that when each of the ends 82, 84 of the pipes are thusly engaged, the pipes are forced to bend outward in the direction of arrow 80 as seen in FIG. 3, with additional bowing shown by the phantom lines in that Figure. When this is accomplished, it would form a barrier of the type as seen in FIG. 2 where the fabric 36 is bowed slightly outward so that when debris such as tree limbs or the like make contact with the fabric in the direction of arrows 86, in FIG. 3, there is a greater cushion against the debris making contact with the window on the opposite side of the bowed fabric as seen in FIG. 3.

It is foreseen that in the preferred embodiment, the vertical reinforcement may be at three foot centers, and may house one inch to three-fourths inch PVC pipe. The type of fabric that would be used would generally be a PVC coated fiberglass, kevlar-type or other high strength and durable fabric having the ability to withstand at least 200 psi force against the reinforced fabric. It is also foreseen that in the alternative, rather than have the members 50 attached directly to the upper surface 60 of window frame 16 as seen in FIG. 1, there may be included a frame member which can be attached to the surface 60, with the frame member having the plurality of members 50 thereupon. Therefore, when the system would be fully removed from the window, that base plate could be removed also with the members 50 removed along with it.

In the preferred embodiment, the shade would extend over the edges of the windows three inches on each side of the window, and after a storm for example, has passed, the individual pipes 72 can be disengaged from the members 50, both of their upper and lower ends 82, 84, can be slidably disengaged from the pockets 70 of the shade, and the shade can then be rolled back into the storage configuration as seen in FIG. 5. Following that, the shade can either be maintained within the housing 20 in a more permanent nature as seen in FIG. 1, or the owner may wish to completely remove the housing from the window, and the individual members 50 from the sill or the plate if a plate is used on the sill, and stored away for future use.

The foregoing embodiments are presented by way of example only; the scope of the present invention is to be limited only by the following claims. As an additional refinement, this system will have means for attaching the vertical edges of the protective fabric to the structure, with elastic or rubber type straps or bungees.

What is claimed is:

1. A storm protection barrier for windows, comprising:

a. a portion of fabric of sufficient width to cover the window to be protected;

b. a roller having a rolling axis secured within a housing that is adapted to be placed adjacent a top of the window to allow the fabric to roll from the roller to a distance at a lower end of the window;

c. a plurality of spaced apart pockets formed along substantially the length of the fabric portion in a direction perpendicular to the rolling axis;

d. a plurality of tubular members, each member removably inserted within each of the plurality of pockets along the length of the fabric; and e. a first plurality of members that are adapted to be secured to the window sill for engaging lower ends of the tubular members after the tubular members are positioned within the pockets;

f. a second plurality of members secured adjacent the housing for engaging upper ends of the tubular members after the tubular members are positioned within the pockets;

g. each of the plurality of tubular members being of a length so that when the lower ends of the plurality of members are engaged to the first plurality of members, and the upper ends of the plurality of members are engaged to the second plurality of members, each of the plurality of tubular members are adapted to be bowed away from the window to define a protective space between the fabric and the bowed tubular members and the window.

2. The protection barrier in claim 1, further comprising at least an upper housing mountable on the window for housing the roller upon which the fabric is rolled.

3. The protection barrier in claim 1, wherein the fabric portion is contained as a roll of fabric in the housing as a first storage position and is rolled down in front of the window as a second protection position.

4. The protection barrier in claim 1, wherein the tubular members each comprise a length of PVC flexible tubing.

5. The protection barrier in claim 1, wherein the fabric portion comprises a single section of high strength fabric chosen from a group inclusive of PVC coated fiberglass and KEVLAR having the ability to withstand at least 200 psi of force, that permits light and air penetration.

6. A storm protection barrier for windows, comprising:

a. a portion of fabric of PVC coated fiberglass material of sufficient width to cover the window to be protected;

b. a roller having a rolling axis secured within a housing that is adapted to be placed adjacent a top of the window to allow the fabric to roll from the roller to a distance at a lower end of the window;

c. a plurality of spaced apart pockets formed along substantially the length of the fabric portion in a direction perpendicular to the rolling axis;

d. a plurality of tubular members of flexible PVC material, each member removably inserted within each of the plurality of pockets along the length of the fabric; and e. a first plurality of members that are adapted to be secured to the window sill for engaging lower ends of the tubular members after the tubular members are positioned within the pockets;

f. a second plurality of members secured adjacent the housing for engaging upper ends of the tubular members after the tubular members are positioned within the pockets;

g. each of the plurality of members being of a length so that when the lower ends of the plurality of members are engaged to the first plurality of members, and the upper ends of the plurality of members are engaged to the second plurality of members, each of the plurality of tubular members are adapted to be bowed away from the window to define a protective space between the fabric and the bowed tubular members and the window.

7. The protection barrier in claim 6, wherein the fabric portion is contained as a roll of fabric in the housing in the first storage position and is rolled down in front of the window to the second protection position before the tubular members are inserted in the pockets.

8. The protection barrier in claim 6, wherein the tubular members each include at least an opening on their first and second ends.

9. The protection barrier in claim 6, wherein the fabric portion comprises a single section of KEVLAR fabric having the ability to withstand at least 200 psi of force.

* * * * *